US008046311B2

(12) United States Patent
Ferraro et al.

(10) Patent No.: US 8,046,311 B2
(45) Date of Patent: Oct. 25, 2011

(54) POSTAL INDICIA GENERATING SYSTEM AND METHOD

(75) Inventors: Mark Ferraro, Hamden, CT (US); Daniel Lynch, Bridgewater, CT (US)

(73) Assignee: Neopost Technologies, Bagneux (FR)

( * ) Notice: Subject to any disclaimer, the term of this patent is extended or adjusted under 35 U.S.C. 154(b) by 296 days.

(21) Appl. No.: 12/166,005

(22) Filed: Jul. 1, 2008

(65) Prior Publication Data

US 2010/0004939 A1 Jan. 7, 2010

(51) Int. Cl.
*G07B 17/02* (2006.01)

(52) U.S. Cl. ..... 705/401

(58) Field of Classification Search ..... 705/401
See application file for complete search history.

(56) References Cited

U.S. PATENT DOCUMENTS

| | | | | |
|---|---|---|---|---|
| 5,819,240 | A | 10/1998 | Kara | |
| 6,026,385 | A | 2/2000 | Harvey et al. | |
| 6,308,165 | B1 | 10/2001 | Gilham | |
| 6,820,201 | B1 * | 11/2004 | Lincoln et al. | 713/179 |
| 6,865,561 | B1 | 3/2005 | Allport et al. | |
| 6,986,053 | B1 * | 1/2006 | Schwartz et al. | 713/193 |
| 2002/0077990 | A1 * | 6/2002 | Ryan, Jr. | 705/60 |
| 2003/0101143 | A1 * | 5/2003 | Montgomery et al. | 705/62 |
| 2003/0131280 | A1 * | 7/2003 | Gittins et al. | 714/8 |
| 2006/0173797 | A1 * | 8/2006 | Sheehan et al. | 705/404 |
| 2007/0050317 | A1 * | 3/2007 | McNairy | 705/410 |
| 2008/0092003 | A1 * | 4/2008 | Khoche et al. | 714/733 |
| 2008/0126670 | A1 | 5/2008 | Ehresmann et al. | |

FOREIGN PATENT DOCUMENTS

| | | | |
|---|---|---|---|
| EP | 1 736 934 | A2 | 12/1996 |
| EP | 0 981 111 | A2 | 2/2000 |
| EP | 1 098 471 | A2 | 5/2001 |
| EP | 1 160 735 | A2 | 12/2001 |

OTHER PUBLICATIONS

Sullivan, Kristina B., "Digital Certificates Grow Up," PC Week, vol. 16, Issue 9, Mar. 1, 1999, p. 143.*

* cited by examiner

*Primary Examiner* — Nathan Erb
(74) *Attorney, Agent, or Firm* — Morris & Kamlay LLP

(57) ABSTRACT

A method for generating a postal indicia associated with a mailpiece is disclosed. The method includes generating an indicia data stream including a postal information segment and a security segment that is based upon the postal information segment and modifying a portion of the security segment to include additional information, thereby defining a modified indicia data stream.

24 Claims, 6 Drawing Sheets

POSTAL INDICIA GENERATING SYSTEM AND METHOD

BACKGROUND OF THE INVENTION

The present disclosure relates generally to generation of postal indicia data streams, and particularly to generation of postal indicia data streams including additional information.

Postal meters provide postal indicia to indicate an amount of postage necessary for delivery of a mailpiece. Therefore, postal indicia incorporate security to prevent fraudulent activity. One example of an indicia is an IBI indicia, which is a two dimensional barcode rendering of a data stream. The IBI indicia data stream has a length of 89 bytes that includes 49 bytes of postal information (payload) and 40 bytes of security in the form of a Public Key Infrastructure (PKI) signature of the payload. As another example, an IBI-Lite indicia is a two dimensional barcode rendering of a 20 byte data stream having 14 bytes of payload and 6 bytes of security in the form of a Message Authentication Code (MAC) signature of the payload.

A postal security device (PSD) includes firmware having a cryptographic engine for generating a signature (security region) of the indicia data stream. Generation and processing of indicia data streams must meet certain FIPS (FEDERAL INFORMATION PROCESSING STANDARDS) requirements, such as FIPS 140-2 for example, which defines the protocol(s) for cryptographic module security requirements. As relates to cryptographic components within postal equipment, such as the PSD, compliance with FIPS requirements is determined by a third-party certification process, which is typically expensive and time-consuming.

Accommodation of additional information within the indicia data stream, such as information related to an additional desired postal service for example, requires a change to a format of the postal indicia. One example of a change to the format of the postal indicia includes an increase in size of the payload relative to the security region. Such indicia format changes require changes to encryption algorithms employed by PSD firmware and recertification of the PSD design. Revision of the firmware to accommodate a change in the indicia format is therefore undesirable. Accordingly, there is a need in the art for an indicia generation arrangement that overcomes these drawbacks.

BRIEF DESCRIPTION OF THE INVENTION

An embodiment of the invention includes a method for generating a postal indicia associated with a mailpiece. The method includes generating an indicia data stream having a postal information segment and a security segment based upon the postal information segment. A portion of the security segment is modified to include additional information, thereby defining a modified indicia data stream. The modified indicia data stream is rendered as the postal indicia and the postal indicia is associated with the mailpiece.

Another embodiment of the invention includes a postal metering system having a postal security device and a controller. The postal security device produces an indicia data stream having a postal information segment and security segment based upon the postal information segment. The controller is in signal communication with the postal security device and modifies a portion of the security segment to include additional information, thereby defining a modified indicia data stream. The controller further renders the modified indicia data stream as a postal indicia and associates the postal indicia with the mailpiece.

A further embodiment of the invention includes a method of verifying authenticity of a postal indicia. The method includes applying an encryption algorithm to a postal information segment of a postal indicia data stream and comparing an output of the applied algorithm to a security segment of the postal data stream. In response to the compared output not matching the security segment, the method defines a subportion of the security segment to exclude and compares a portion of the security segment excluding the defined subportion to a corresponding portion of the output of the applied algorithm. In response to the compared portion of the security segment matching the applied algorithm, the method determines that the postal indicia is authentic.

These and other advantages and features will be more readily understood from the following detailed description of preferred embodiments of the invention that is provided in connection with the accompanying drawings.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention accommodates additional information within an established indicia data stream format. Incorporation of the additional information within the established indicia data stream format obviates PSD firmware changes and recertification. Examples of additional information include, but are not limited to: information relating to one or more additional desired postal services that may be provided by any of a postal authority and a mailing services vendor, such as a service code; information related to an identity of a sender of the mailpiece, such as an email address, a social security number, financial account information, or another identifier; information related to the mailpiece, such as any of statistical and financial information, and a unique identifier; delivery information such as an 11-digit zip code, a postal onecode or intelligent mail barcode, a cleansed address obtained via an external database, and an address cleansing status; and any other information that may be useful to any of a sender of a mailpiece, the mailing services vendor, and the postal authority.

As described above and defined by FIPS, established indicia data stream formats have a number of bytes allocated for the security region based upon a size of the payload region, and a security algorithm (e.g.: 6, 14, and MAC, respectively, for the IBI-Lite Indicia). An embodiment modifies one or more bytes of the indicia data stream within the security region following generation thereof by the PSD. In an embodiment, the payload region, and therefore the appropriate encryption algorithm employed by the PSD, is not modified to accommodate the modification of the security region. Accordingly, PSD firmware need not be modified and FIPS recertification is not required.

In one embodiment, the modified bytes of the indicia data stream can represent service information (such as a tracking identifier for example), and/or any other useful information that may identify or relate to customer or postal services. The modified indicia data stream is rendered, via a two-dimensional barcode for example, and associated with the mailpiece for deposition into a mailstream with the postal authority (such as the United States Postal Service for example) for delivery.

Another embodiment includes an intelligent indicia verification process. The intelligent indicia verification process can test a full security region of the indicia (such as that of an unmodified indicia data stream). If the unmodified indicia data stream fails authentication, the process determines if the indicia data stream has been modified and identifies the security region of the modified indicia data stream. The process further audits the security region of the modified indicia data stream and may validate that the modified portion properly represents valid information, such as a valid service code for example.

Figure 1:
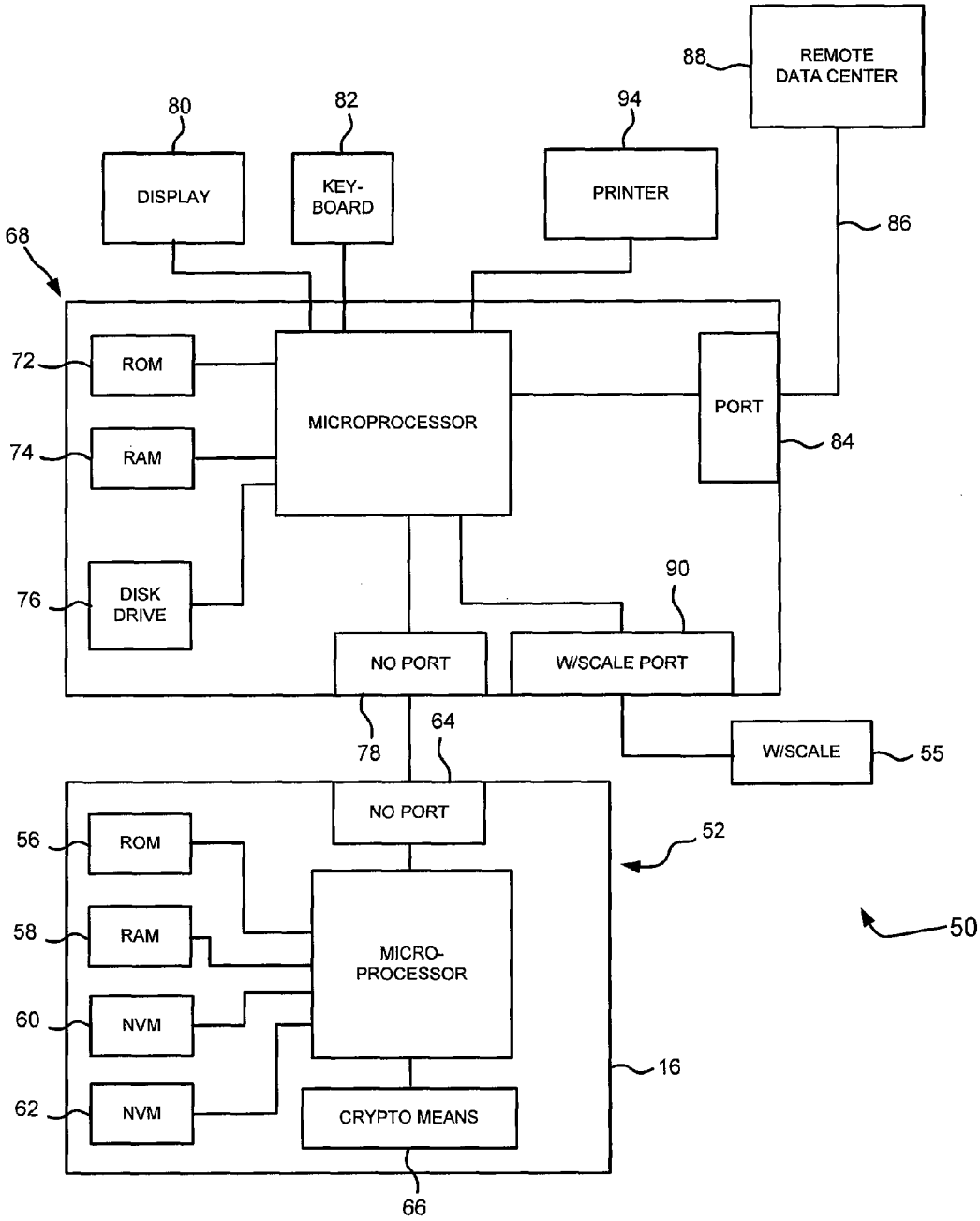
FIG. 1 depicts a block schematic diagram of an exemplary postal metering system in accordance with an embodiment of the invention.

FIG. 1 depicts a postal metering system 50 in accordance with an embodiment of the present invention. The system 50 includes a postal security device (PSD) 52 which is operable to perform accounting related to dispensing of postage charges that correspond to delivery of mailpieces, such as generation of the indicia data stream, as will be described further below.

An exemplary embodiment of the PSD 52 includes electronic accounting means comprising a microprocessor 54, a read-only memory (ROM) 56 storing program routines for operation of the microprocessor 54, a random access memory (RAM) 58 for use as a working store for the temporary storage of data during operation of the PSD 52, and non-volatile duplicated memories 60, 62 for the storage of data relating to the use of the PSD 52, specifically, accounting data relating to the dispensing of postage charges, which is required to be retained even when the PSD 52 is not powered.

The microprocessor 54 performs accounting functions in relation to the dispensing of postage value for postage charges applicable to the handling of mailpieces by a postal authority or other carrier. As will be appreciated by one of skill in the art, the accounting data can include a value of credit, an accumulated total of the value dispensed by the PSD 52, and a count of mailpieces processed by the PSD 52. For example, the value of credit may be stored in a descending register, the accumulated total value stored in an ascending register, and the count of mailpieces in an item count register. Each of the foregoing registers may be replicated, such as in NVM 60, 62 to enable the integrity of the accounting data to be maintained even in the event of a fault or termination of power to the PSD 52 during operation of the system 50. The PSD 52 includes an input/output port 64 which is connected to the microprocessor 54 and provides for external communication with the microprocessor 54. The PSD 52 further includes a cryptographic engine 66 for generating an indicia data stream, as will be described further below. It will be appreciated that while the cryptographic engine 66 is depicted separate from microprocessor 54 for generating signatures or encrypting information, the scope of the invention is not so limited, and is contemplated to include embodiments in which the function of cryptographic engine 66 is implemented by the microprocessor 54 operating under software routines to generate digital signatures or encrypt information.

The system further includes a controller 68 operatively coupled with the PSD 52 for controlling the operation of the PSD 52. The controller 68 modifies the indicia data stream generated by the PSD 52, such as by replacing less than all of the security segment information with the additional information. In one embodiment, the controller 68 is responsive to user selection of the additional desired postal service to modify the indicia data stream to include information pertaining to, inter alia, the additional postal service.

In one embodiment of the system 50, known as an "open system", the controller 68 is a general purpose computer that is operatively coupled to the PSD 52 via the input/output port 64 of the PSD 52. The controller 68 may be a desk-top computer which includes a microprocessor 70, a read-only memory (ROM) 72 storing program instructions, a random access memory (RAM) 74 for use as a working store, and a program storage device 76, such as a disk drive 76 which is operably connected to the microprocessor 70. The computer 68 operates under an operating system which is stored on the disk drive 76 and downloaded at least in part to the RAM 74 when required to be accessed by the microprocessor 70. It will be appreciated that operating system can also reside on memory components such as RAM 74 or ROM 72, as may be known as a 'solid state disk' for example.

The controller 68 includes an input/output port 78 connected to the microprocessor 70 and communicates via the input/output port 64 of the PSD 52 with the microprocessor 54 of the PSD 52. The controller 68 further includes an output device 80 and an input device 82, such as a display for displaying information to an operator of the system and any of a keyboard, mouse, or software interlink for the input of data and operating instructions to the system, respectively.

The controller 68 includes a communication port 84 for communication over a communication link 86, such as a Public Telephone Switching Network, a Local Area Network, a Wide area Network, an intranet, and an Internet, for example. The communication link 86 connects the controller 68 with a remote data centre 88, such as at least one of a postal authority server and a services provider server, for example.

In an embodiment, the controller 68 includes a weighscale port 90 for connection to a weighscale 92 to communicate signals indicative of a weight of mailpieces to the microprocessor 70 for determination of postal charges related to delivery of mailpieces. The controller 68 further includes a printer 94 which is operable under control of the controller 68 to print postage indicia corresponding to mailpieces.

When the system 50 is required to dispense postage charges and print postage indicia for mailpieces, a user can enter, by means of the input device 82, a selection of a mail preparation program, which may be integrated into or accessed from related programs, such as a document preparation program, for example. In this embodiment the program is stored on the program storage device 76, such as a hard disk drive for example. When selected to be run, the program is loaded into the RAM 74 for access by the microprocessor 70 during running of the program. If desired, the controller 68 may be arranged to run the mail preparation program automatically upon power-up of the system. Running of the mail preparation program causes the microprocessor 70 to operate the display 80 to display a main operating screen, for example.

While an embodiment of the system 50 has been described and illustrated as an "open system", such as a software application in execution upon a general purpose computer, it will be appreciated that that the scope of the invention is not so limited, and applies to other postal metering systems. One exemplary postal metering system contemplated includes what is known as a "closed system" that integrates the controller 68 with the PSD 52 within a secure hardware perimeter and establishes a point to point connection between the printing function of printer 94 and PSD 52. Another exemplary postal metering system is known as a "virtual system" in which one or more PSDs 52 are located remote to the controller 68, such that the PSD 52 is physically located at a secure data center remote from the controller 68 and coupled to the controller 68 via a communication link, such as the Internet, for example. Any of these embodiments of systems, including the system 50 shown in FIG. 1 can implement a method, described below, in accordance with embodiments of the present invention.

Figure 2:
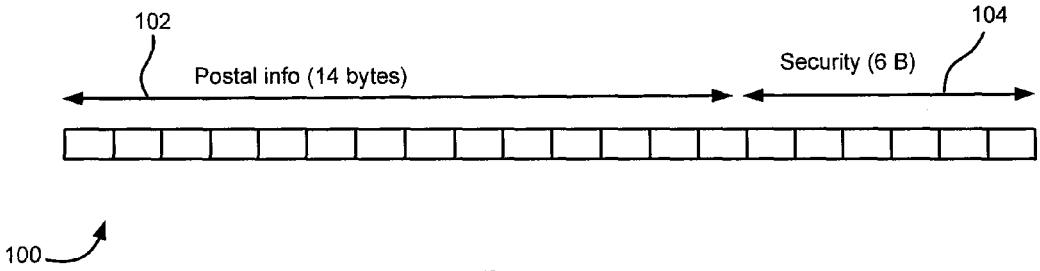
FIG. 2 depicts an embodiment of an exemplary prior art indicia data stream.

FIG. 2 depicts an exemplary prior art embodiment of an indicia data stream 100 that is generated using the cryptographic engine 66 of the PSD 52, such as a 20 byte IBI-Lite indicia data stream 100, for example. The indicia data stream 100 includes a payload region 102 (also herein referred to as a "postal information segment") and a security region 104 (also herein referred to as a "security segment"). In the exemplary 20 byte indicia data stream 100, the payload region 102 includes 14 bytes of data and the security region 104 includes 6 bytes of data.

The PSD 52 can receive postal information, such as one or more of a serial number associated with the PSD 52, characteristics (such as physical size and weight) of a mailpiece for which postage is desired, a postage value associated with delivery of the mailpiece, a location (zip) code associated with a post office, and one or more incrementing data items, such as a piece counter value or ascending register value for example. The postal information thereby defines a unique indicia data stream 100 corresponding to the mailpiece.

The security region 104 is based upon the payload region 102. For example, at least some of the postal information can be provided to the cryptographic engine 66 of the PSD 52 (via the controller 68) in a given format as the payload region 102. A cryptographic engine 66 that implements an appropriate algorithm (such as a MAC or PKI, for example) can receive the data of the payload region 102, and produce the data of the security region 104. As described above, the particulars of the encryption algorithm shall be certified as meeting requirements set forth by FIPS. A change in a format of the payload region 102, such as to include additional information therein for example, results in an accompanying change of the encryption algorithm within the cryptographic engine 66 to generate the security region 104. It will be appreciated that any such changes to the encryption algorithm therefore require FIPS recertification of the design of the PSD 52.

Figure 3:
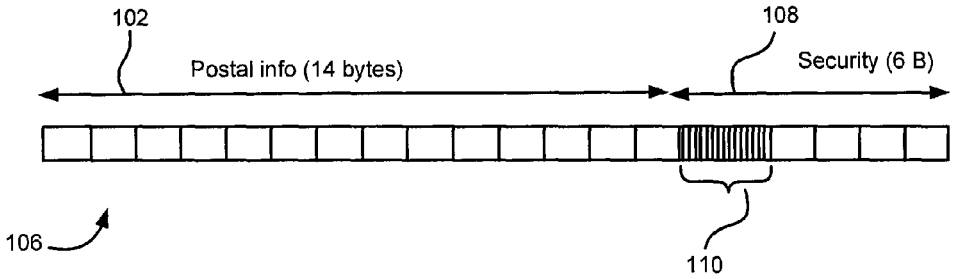
FIG. 3 depicts an exemplary modified indicia data stream in accordance with an embodiment of the invention.

FIG. 3 depicts an embodiment of an indicia data stream 106 modified to include additional information therein subsequent to generation thereof by the PSD 52. The modified indicia data stream 106 includes the payload region 102 and a modified security region 108. In an embodiment, a size of the payload region 102 of the modified indicia data stream is the same as a size of the payload region 102 of the indicia data stream 100, such that the PSD 52 utilizes the same encryption algorithm within the cryptographic engine 66. Following encryption of the payload region 102 by the PSD 52, a portion 110 that is less than all of the security region 104 is modified, via insertion of additional information such as a service code, for example, thereby providing the modified security region 108. For example, as depicted in FIG. 3, the modified portion 110 of the modified security region 108 can be two bytes. As described above, in one embodiment, the additional information within the modified portion 110 can correspond to desired additional postal services, such as at least one of tracking, delivery confirmation, signature confirmation, certified mail, etc., for example. Additional examples of postal services that can utilize the additional information include: generation of financial and accounting business reports; payment for postage and/or services via financial information such as a hash of a credit card number; and increased ease and reduced cost of delivery via delivery information.

Figure 4:
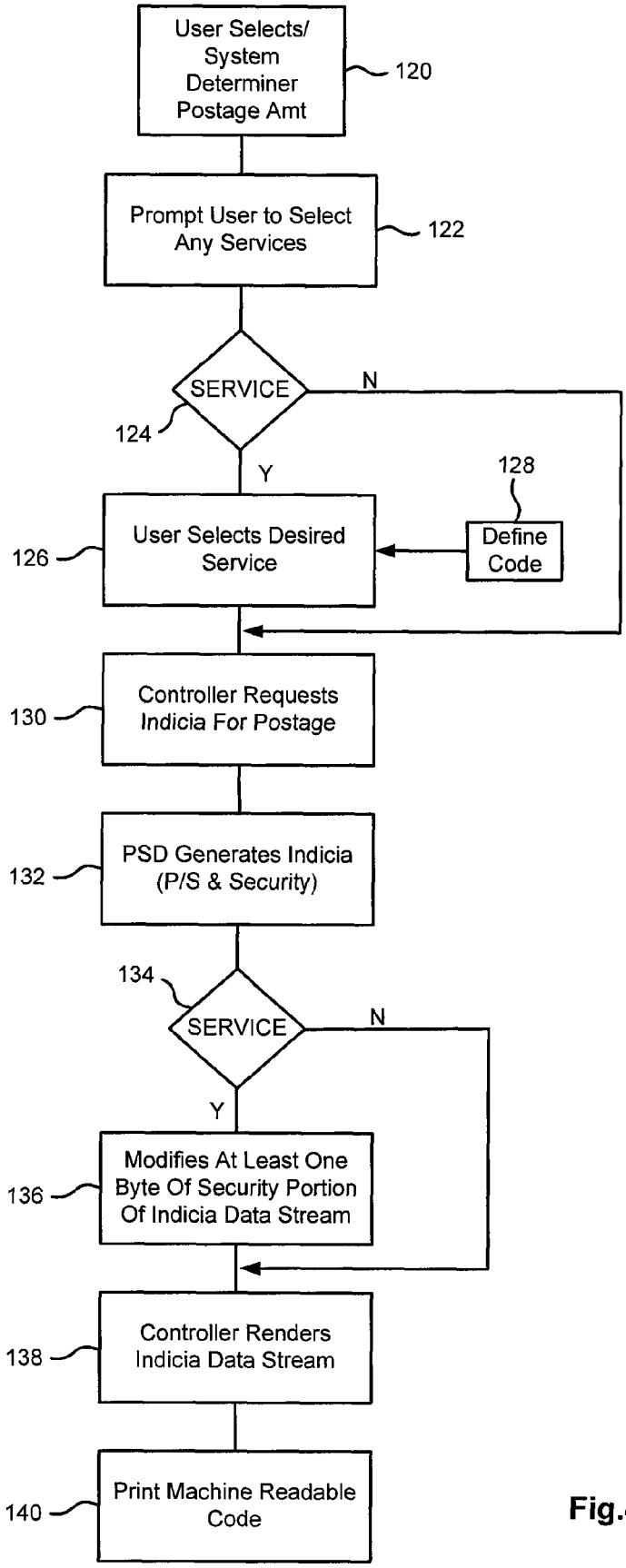
FIG. 4 depicts a flowchart of process steps for generating and providing the modified indicia data stream of FIG. 3 in accordance with an embodiment of the invention.

In view of the foregoing, the system 50 facilitates a method of generating a postal indicia. FIG. 4 depicts a flowchart of process steps for one embodiment of a method for generating and providing the modified indicia data stream 106. The process begins at step 120 with selecting an amount of postage to provide upon a mailpiece. The selecting the amount of postage, at step 120, can be manual, such as an amount that is requested or selected by a user of the system 50, for example. The selecting, at step 120, can also be automated, such an amount that is automatically determined by the system 50 based upon mailpiece characteristics, such as at least one of weight and dimensions of the mailpiece that are related to Shape-Based-Pricing, for example.

The system 50 then determines if the security region 104 is to be modified with the insertion of the additional information. For example, at step 122, the output device 80 prompts the user of the system 50 to determine if the user desires any additional postal services to be applied to the mailpiece. Decision block 124 determines the user response to the prompt at step 122. If the user selects a desired service at step 126, such as via a drop down menu displayed upon output device 80, the method proceeds to step 128 wherein the controller 68 utilizes a database within any of program storage 76, ROM 72, and remote data center 88 to define the additional information, such as a code associated with the desired service for example. The additional information may be so defined, such as via a look up table, for example. The defined information is contemplated to be a portion of the security region 104.

If decision block 124 determines that the user does not desire any additional postal services, and thus the security region 104 is not to be modified, the method proceeds to Step 130.

At Step 130 the controller 68 requests an indicia data stream, such as the indicia data stream 100, corresponding to at least the amount of postage selected by step 120 from the PSD 52. In addition to the amount of postage selected at step 120, if appropriate, the amount of postage requested at Step 130 can also include any additional costs that may be related to the desired service selected at step 126.

At Step 132, the PSD 52 generates the indicia data stream 100 and provides the generated indicia data stream 100 to the controller 68 for association with the mailpiece. At Decision block 134 (similar to decision block 124), if the security region 104 is to be modified with the insertion of additional information, such as a selection of additional postal services, the method proceeds to step 136.

At Step 136, the controller 68 modifies the indicia data stream 100 by overwriting a portion of the security region 104 with the additional information defined at step 128. For example, the portion 110 of the security region 104 is overwritten by the information, defined at Step 128, such as a service code for example, and thereby defines the modified security region 108 of the modified indicia data stream 106.

If decision block 134 (similar to decision block 124) determines that the security region will not be modified, for example the user does not desire any additional postal services, the method proceeds to Step 138.

At Step 138, the controller 68 renders the indica data stream 100 (or the modified indicia data stream 106, if appropriate) into a machine readable code, such as a two-dimension barcode, for example. Step 140 associates the machine readable code with the mailpiece, such as at least one of printing directly upon the mailpiece, printing upon a label subsequently affixed to the mailpiece, and printing upon a sheet inserted within the mailpiece such that the machine readable code is visible through a window of the mailpiece, such as described in U.S. Pat. Nos. 7,257,558 and 7,226,494, incorporated herein by reference in their entirety, for example.

While an embodiment has been described wherein the system 50 is responsive to user selection of the desired additional postal service to modify the security region 104 to include the additional information and provide the modified security region 108, it will be appreciated that the scope of the invention is not so limited, and is contemplated to include modification of the security region 104 absent such user selection, such as to automatically modify the security region 104 to include any of the examples of additional information described above and desired by any of a user, a mail services vendor, and a postal authority.

Figure 5:
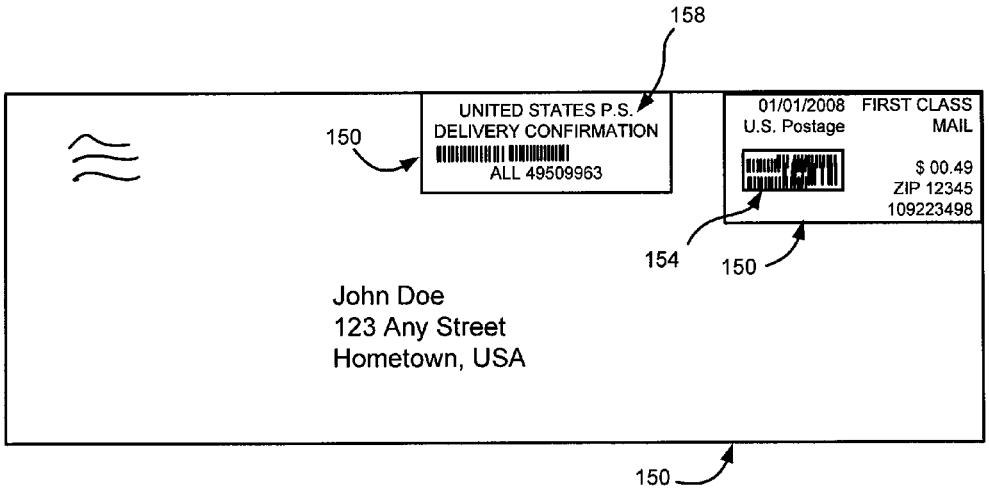
FIG. 5 depicts an exemplary mailpiece in accordance with an embodiment of the invention.

FIG. 5 depicts an exemplary mailpiece 150 having an indicia 152 including a machine readable code 154. In an embodiment, in response to user selection of the desired additional postal service at step 126, the system 50 provides, such as by printing via printer 94 for example, additional postal service information 156 upon the mailpiece 150. The service information 156 indicates that the user has selected the desired additional postal service and provides data allowing the postal authority to perform tasks corresponding to the selected service, such as to monitor (track) a delivery progress status of the mailpiece 150 throughout the mailstream, for example.

In an embodiment, the service information 156 includes at least one of human readable information and machine readable information related to the desired service selected at step 126. Human readable information includes at least one of a description of the service 158 and a unique-mailpiece tracking number 160 that can be used for status information relating to the service selected at step 126, such as to track delivery status of the mailpiece, for example. Machine readable information may include a barcode 162, such as a barcode that represents the human-readable unique-mailpiece tracking number 160, for example. An embodiment that uses the barcode 162 representation of the tracking number 160 allows the postal authority to utilize present infrastructure for the provision of the service, such as tracking of the mailpiece 150 for example.

It will be appreciated that the modified indicia data stream 106 including the code defined at step 128 and associated with the desired service in the portion 110 defines a unique identifier. It will be further appreciated that the machine readable code 154 representation of data within the modified indicia data stream 106 can, in and of itself, serve as the service information 156 for subsequent tracking of information related to the selected service, such as tracking of delivery status of the mailpiece, for example.

Figure 6:
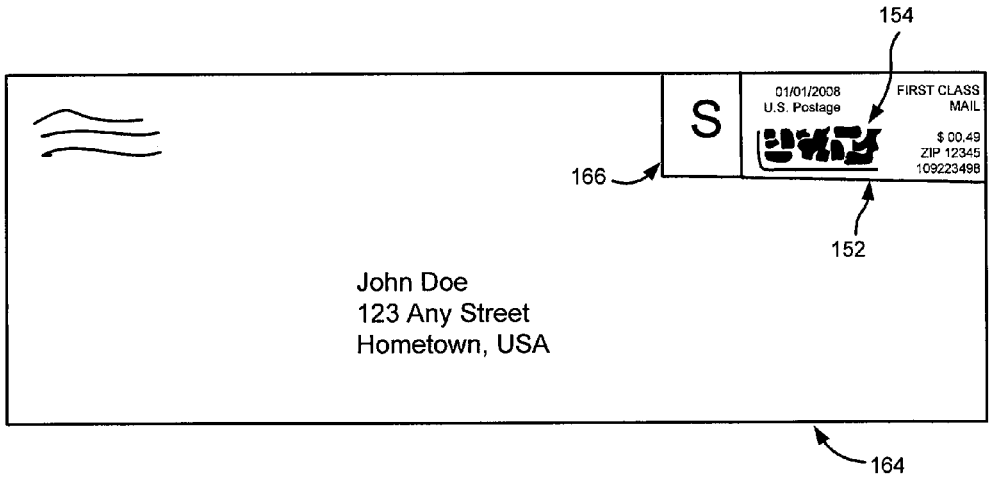
FIG. 6 depicts another exemplary mailpiece in accordance with an embodiment of the invention.

FIG. 6 depicts another exemplary mailpiece 164 having the indicia 152 that includes the machine readable code 154. In an embodiment, in response to user selection of the desired service at step 126, the system 50 (via printer 94 for example) provides a service indicator 166 (absent service information 156) upon the mailpiece 164 that indicates that the user has selected the desired service without providing any of the service information 156 detail upon the mailpiece 164. The service indicator 166 is displayed as an indication that the user has selected a service, and thereby informs the postal authority of a need to scan the machine readable code 154, decode the modified indicia data stream 106 represented therein, and perform tasks corresponding to the selected service, such as to monitor (track) a delivery progress status of the mailpiece 164 throughout the mailstream, for example. In one embodiment, the service indicator 166 may be an alteration of a FIM (facing identification mark) to indicate selection of the desired service.

Following selection of the desired service and deposition of the mailpiece 150, 164 into a mailstream at the postal authority, the user may be provided with means for determining a status of the mailpiece 150, 164, such as a delivery or tracking status, for example.

One exemplary means includes provision to the user of a copy of the human-readable unique-mailpiece tracking number 160. The user may then enter the number 160 into a web portal of the postal authority to determine the status corresponding to the desired service of the mailpiece 150.

Figure 7:
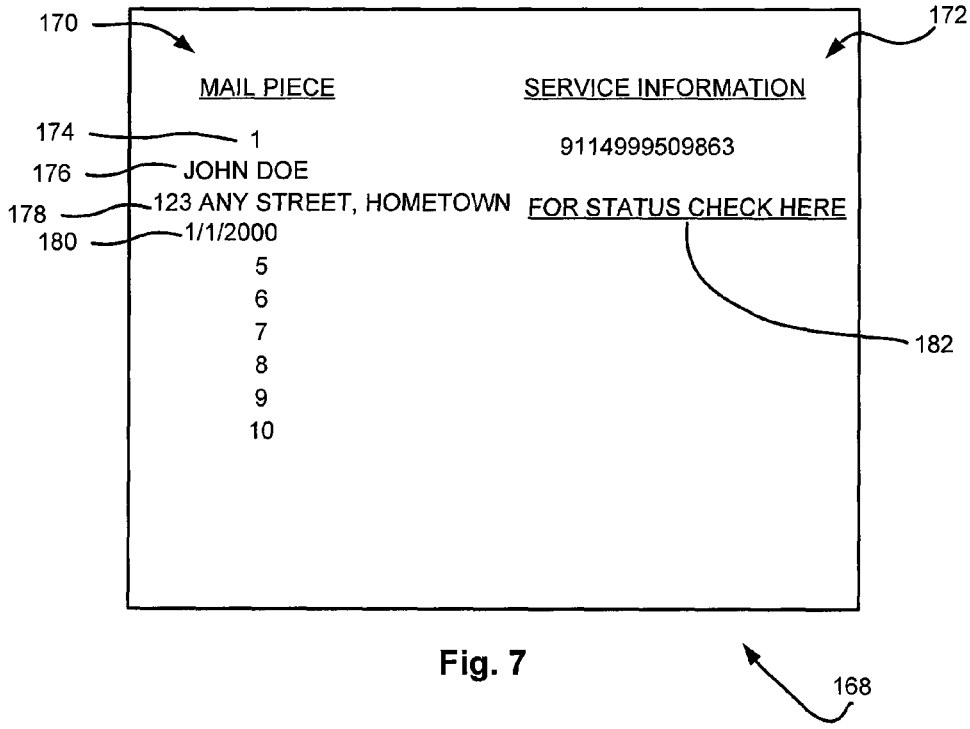
FIG. 7 depicts an exemplary list of mailpieces in accordance with an embodiment of the invention.

FIG. 7 depicts a list 168 or manifest of mailpieces for which the user has selected one or more additional postal services. The list 168 can include a first column 170 with information representative of the mailpiece 150, 164 and a second column 172 with information representative of the selected postal service corresponding to a mailpiece in the first column 170. The first column 170 includes a reference to the mailpiece 150, 164 such as any of a number 174, an addressee name 176, a delivery address 178, and a mailing date 180, for example. The second column 172 includes information related to the selected service, such as the tracking number 160. In one embodiment, the list 168 is an electronic list, which may be provided upon display 80 for example, and includes a link 182 to status information corresponding to the selected service for each mailpiece within the list 168. The link 182 may be either direct to the postal authority or via a service provider that receives information from the postal authority and appropriately makes it available to users of the mailing system 50. Alternatively, the list 168 may include a hard copy print out of the human-readable information 158, 160 for subsequent entry into a postal authority web-portal, for example.

It will be appreciated that the embodiments of the mailpieces 150, 164 in FIGS. 5 and 6 include visible indication, such as the service information 154 and service indicator 166, that the desired service has been selected (and therefore additional information has been inserted within the security region 108). Such indication may thereby provide a cue to others (in addition to the user that selected the service) that the additional information, such as information relating to the status of the service, has been inserted within the security region 108. In one embodiment, access to information relating to the status of the service may be limited by providing such access exclusively via the service provider server 88, thereby limiting any service status information to mailing systems 50 from which mailpieces 150, 164 originate, for example.

Figure 8:
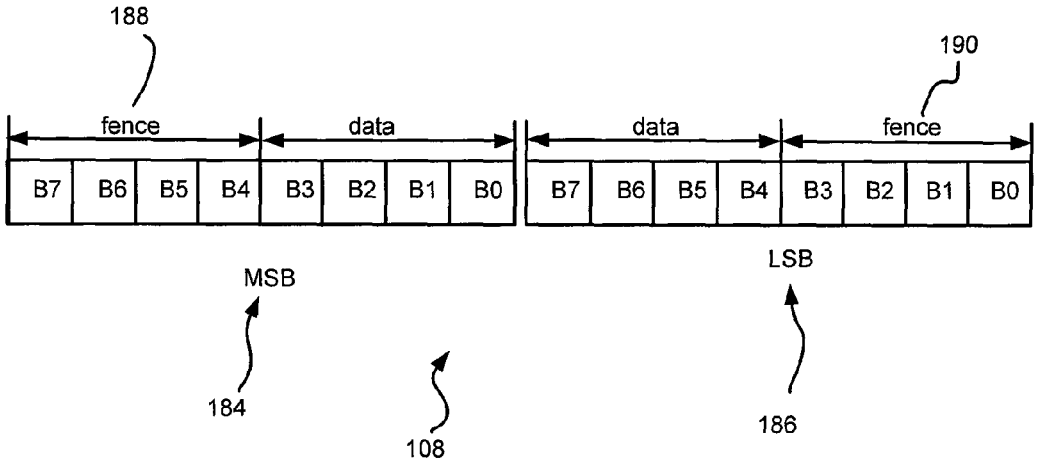
FIG. 8 depicts a portion of the modified indicia data stream of FIG. 3 in accordance with an embodiment of the invention.

In another embodiment, the controller 68 generates an arrangement of data within a specific segment of the modified security region 108 that indicates such modification while the mailpiece is absent any visible indication 154, 166. FIG. 8 depicts a most significant byte 184 and a least significant byte 186 of an exemplary embodiment of the modified security region 108 (FIG. 3). In one embodiment, a specific modification of "fence bits" 188, 190 (such as all binary "1", for example) of at least one of the most significant byte 184 and least significant byte 186 indicates that the portion 110 of the security region 108 has been modified by insertion of the service code. Subsequent to scanning of the machine readable code 154 of the indicia 152 (by the postal authority), presence of the specific modification of fence bits 188, 190 indicates that the indicia 152 includes the modified indicia data stream 106.

While an embodiment has been described utilizing fence bits 188, 190 associated with the most significant byte 184 and least significant byte 186, it will be appreciated that the scope of the invention is not so limited, and can also apply to other arrangements of the modified security region, such as utilizing only one of the most significant byte 184 and least significant byte 186, or utilizing any specified byte or combination of bytes within the modified indicia data stream 106. Further, while an embodiment has been described utilizing binary "1" to indicate modification of the fence bits, it will be appreciated that the scope of the invention is not so limited, and is contemplated to include other modifications, such as utilizing binary "0", or a dynamic modification that may include a checksum of the payload region 102 within the modified security region 108, such as a cyclic redundancy check (CRC) for example, or any recognizable predetermined pattern that can indicate that a security region is a modified security region 108.

Figure 9:
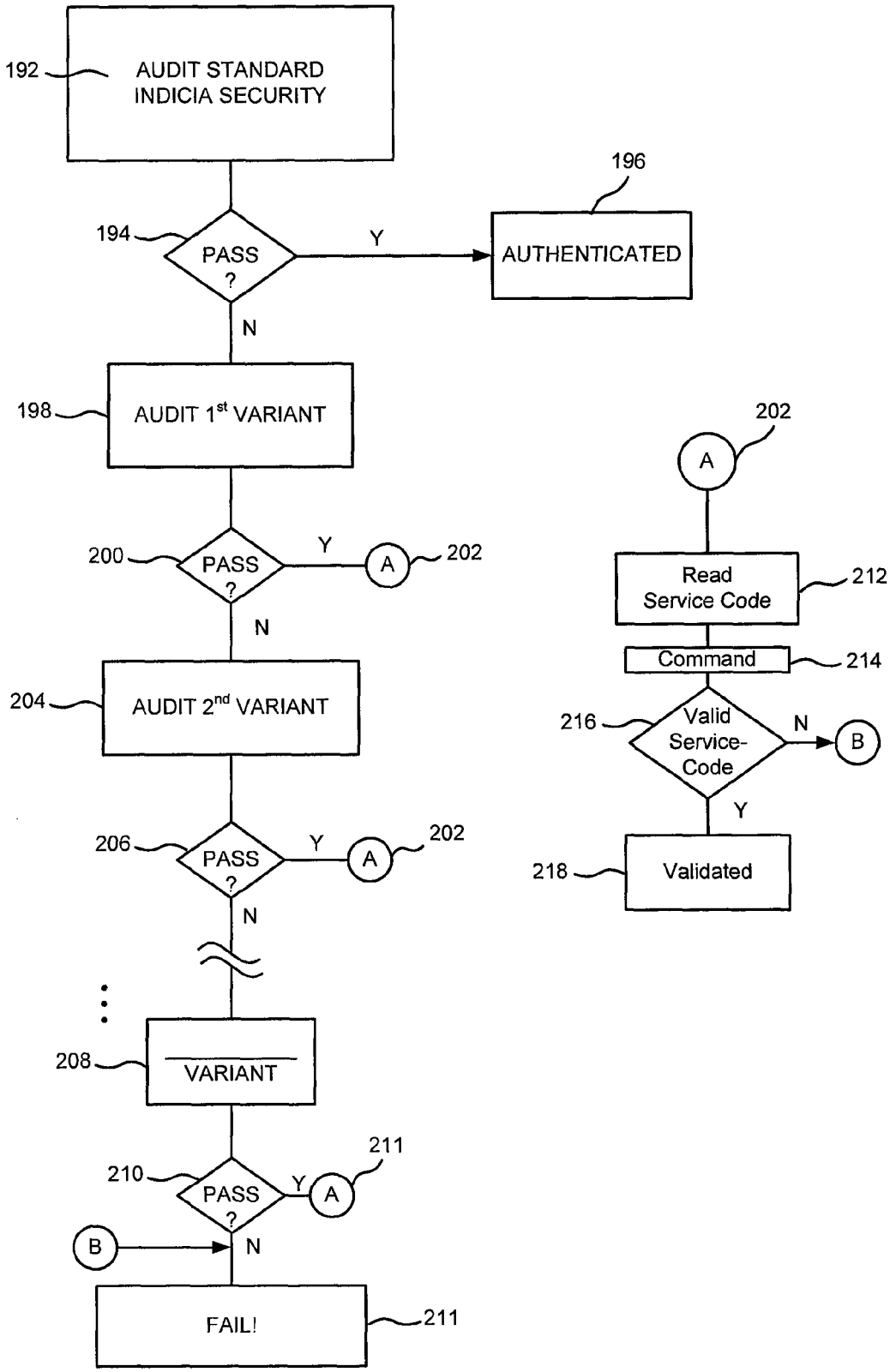
FIG. 9 depicts a flowchart of process steps of a method for an "Intelligent Audit" of an indicia data stream in accordance with an embodiment of the invention.

It will be appreciated that by virtue of modification, the modified security region 108 may differ from the security region 104 and result in uncertainty regarding authenticity of data within the payload region 102. FIG. 9 depicts a flowchart of process steps of an embodiment of an "Intelligent Audit" method for verifying the indicia data stream 100, 106 generated by the PSD 52.

The method begins at step 192 by auditing the contents of the security region 104 of a "standard" indicia (e.g. unmodified indicia data stream 100) (such as a 14/6 Byte payload/security region for an IBI-Lite indicia for example.) In one embodiment, the auditing includes applying the same encryption algorithm used by the cryptographic engine 66 to generate the security region 104 from the payload region 102, and comparing the output to the security region 104. Decision block 194 determines if the security region 104 meets the evaluation criteria. For example, if the output of the same encryption algorithm matches the security region 104, the standard indicia data stream 100 passes the audit at step 196, is authenticated, and no further auditing takes place.

If decision block 194 determines that the standard indicia data stream 100 does not pass the audit, the method audits one or more variants of the indicia data stream 100 as the modified indicia data stream 106. As an example, at step 198, the method audits a first variant of the modified indicia data stream 106, such as to ignore a first byte of the security region 104, presuming that 1 byte of additional information has been introduced/written over the first byte, thereby defining the modified security region 108. Accordingly, the exemplary auditing includes applying the same encryption algorithm used by the cryptographic engine 66 to generate the security region 104 from the payload region 102, and comparing all but the first byte of the output to all but the first byte of the security region 104. Decision block 200 determines if the output meets the evaluation criteria. For example, if the output of all but the first byte of the same encryption algorithm matches all but the first byte of the security region 104, the modified indicia data stream 106 passes the audit at step 202, and the method may proceed, to an optional additional information validation as will be described further below.

If the first variant is does not pass the audit, a second variant (such as to ignore the first two bytes of the security region 104, presuming that 2 bytes of additional information have been inserted) is tested in a similar manner via process steps 204, 206. Furthermore, the process proceeds, in like fashion, through to steps 208, 210 to test up to a (n−1)th variant. (It will be appreciated that n−1 represents a number of combinations of possible arrangements of the modified security region 108 that include insertion of the additional information). The process will continue until either a variant of the modified security region 108 passes the audit, (as shown by process step 202) or no passing variant is found, and the process invalidates, at step 211, the authenticity of the indicia data stream 100, 106.

Although the above process is described with respect to the first and first two bytes, it will be appreciated that other arrangements may be employed, such as to utilize the last one, last two, other numbers of bytes, alternating placement, and framing (such as first and last) bytes of the security region into which the additional information defined at step 128 (FIG. 4) may be entered. Further, while an embodiment of the process is described above as applying the same encryption algorithm, (symmetrical encryption), it will be appreciated that other embodiments may apply a different encryption algorithm, such as asymmetrical encryption utilizing a public key infrastructure (PKI) arrangement, for example without departing from the scope of the invention.

In one embodiment, upon determination that the modified security region 108 passes the audit, the method includes the additional information validation, shown to commence from process step 202.

Any bytes of the security region that are excluded from the foregoing "intelligent audit" are thereby defined, and read, at step 212 as the additional information. At step 214, the defined additional information is compared to a known list of valid additional information, such as service codes for example. One exemplary source of the known list is a look up table maintained within any of an internal database, such as within program storage device 76, or an external database within remote data center 88.

Decision block 216 determines if the defined additional information read at step 212 is found within the known list of valid additional information. If it is, the method proceeds to block 218, and the modified indicia data stream 106 is considered to be validated, i.e. the modified security region 108 is considered to confirm the validity of the payload region 102 data.

If the defined additional information is not found within the known list of valid additional information, the method proceeds to step 211, and the indicia data stream 100, 106 is considered to be fraudulent, and invalid.

It will be appreciated that fraud detection schemes employed by the postal authority may include a number of indicia screening levels. Some screening levels, such as comparison of indicia data streams, avoid a need for full authentication of the data streams 100, 106 if initial screenings are absent signs of fraudulent activity. Such comparisons may not initially identify the presence of the modified security region 108 that includes the service code selected at step 126. Utilization of embodiments including at least one of the visible service information 156 and the service indicator 166 thereby signal a need to flag a presence of the inserted additional information and perform tasks in accordance therewith.

Although an embodiment of the modified indicia data stream 106 has been shown in FIG. 3 having the modified portion 110 including two bytes it will be appreciated that the scope of the invention is not so limited and the modified portion 110 may include any number of bytes less than the total number of security region 104, 108 bytes.

Further, while embodiments of the machine readable code 154 have been described as optical machine readable codes, such as printed barcodes, it will be appreciated that the scope of the embodiments are not so limited, and include other forms of machine readable code, such as radio frequency identification (RFID) tags that may be placed or printed upon or within the mailpiece for example.

An embodiment of the invention may be embodied in the form of computer-implemented processes and apparatuses for practicing those processes. Embodiments of the present invention may also be embodied in the form of a computer program product having computer program code containing instructions embodied in tangible media, such as floppy diskettes, CD-ROMs, hard drives, USB (universal serial bus) drives, or any other computer readable storage medium, wherein, when the computer program code is loaded into and executed by a computer, the computer becomes an apparatus for practicing the invention. Embodiments of the invention also may be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing the invention. When implemented on a general-purpose microprocessor, the computer program code segments configure the microprocessor to create specific logic circuits. A technical effect of the executable instructions is to generate a postal indicia data stream by way of an encryption algorithm associated with a first quantity of data content wherein the generated postal indicia data stream includes a second quantity of data content that is greater than the first quantity of data content.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method for generating a postal indicia indicium associated with a mailpiece, the method comprising:

generating, by a computer system, an indicia data stream having a postal information segment and a security segment based upon an encryption of the postal information segment with a first encryption algorithm;

overwriting, by the computer system, a portion of the security segment to include additional information, thereby defining a modified indicia data stream, the additional information not being encrypted with the first encryption algorithm;

rendering the modified indicia data stream as the postal indicium; and altering the mailpiece such that the postal indicium is readable from the mailpiece.

2. The method of claim 1, further comprising:

receiving, at a postal security device, postal information pertaining to the mailpiece, the postal information defining the postal information segment; and wherein the generating comprises applying the first encryption algorithm to the postal information segment to define the security segment and appending the security segment to the postal information segment.

3. The method of claim 1, wherein:

the generating is via a cryptographic engine of a postal security device; and the overwriting is via a postal metering system controller.

4. The method of claim 1, wherein the postal indicium comprises a two dimensional barcode.

5. The method of claim 1, wherein:

the overwriting is in response to user selection of an optional postal service; and the additional information includes information about the optional postal service.

6. The method of claim 5, further comprising:

receiving service information relating to the optional postal service; and printing upon the mailpiece the service information.

7. The method of claim 5, further comprising:

in response to user selection of the optional postal service, defining a code corresponding to the optional postal service;

wherein the overwriting comprises overwriting the defined code upon the security segment.

8. The method of claim 5, further comprising:

in response to the user selection of the optional postal service, printing upon the mailpiece a service indicator.

9. The method of claim 1, wherein the altering comprises printing the rendered postal indicium upon the mailpiece.

10. The method of claim 1, wherein the altering comprises printing the rendered postal indicium upon a sheet inserted within the mailpiece.

11. The method of claim 1, further comprising including a checksum of the postal information segment in the modified portion of the security segment to indicate that the security segment has been modified.

12. The method of claim 1, further comprising inserting a predetermined pattern within the modified portion of the security segment to indicate that the security segment has been modified.

13. The method of claim 1, wherein the additional information is not found in the postal information segment.

14. The method of claim 1, wherein the altering comprises altering the mailpiece such that the mailpiece includes a radio frequency identification tag from which the postal indicium is readable.

15. A system for generating a postal indicium associated with a mailpiece, comprising:

a postal security device; and a controller, in signal communication with the postal security device;

wherein the system is configured to perform a method comprising:

generating, by the postal security device, an indicia data stream having a postal information segment and a security segment based upon an encryption of the postal information segment with a first encryption algorithm;

overwriting, by the controller, a portion of the security segment to include additional information, thereby defining a modified indicia data stream, the additional information not being encrypted with the first encryption algorithm;

rendering, by the controller, the modified indicia data stream as the postal indicium; and altering the mailpiece such that the postal indicium is readable from the mailpiece.

16. The system of claim 15, wherein the controller generates a checksum of the postal information segment and inserts the checksum within the modified portion of the security segment to indicate that the security segment has been modified.

17. The system of claim 15, further comprising:

an input device receptive of postal information relating to the mailpiece and user selection of an optional postal service;

wherein the postal security device and the controller are in signal communication with the input device; and wherein the controller is responsive to user selection of the optional postal service to modify the portion of the security segment to include additional information about the optional postal service.

18. The system of claim 17, further comprising:

a printer in signal communication with the controller;

wherein the input device is receptive of service information about the optional postal service; and the printer is responsive to the controller to print the service information upon the mailpiece.

19. The system of claim 17, wherein:

the controller is responsive to user selection of the optional postal service to define a service code and overwrite the service code upon the portion of the security segment.

20. The system of claim 19, wherein:

the controller is responsive to user selection of the optional postal service to interrogate a look up table to define the service code.

21. The system of claim 17, further comprising:

a printer in signal communication with the controller;

wherein the input device is receptive of information about the optional postal service; and the printer is responsive to the controller to print a service indicator upon the mailpiece.

22. The system of claim 15, wherein the controller inserts a predetermined pattern within the modified portion of the security segment to indicate that the security segment has been modified.

23. The system of claim 15, wherein the additional information is not found in the postal information segment.

24. The system of claim 15, wherein the altering comprises altering the mailpiece such that the mailpiece includes a radio frequency identification tag from which the postal indicium is readable.

* * * * *